US011568702B2

(12) United States Patent
Jafa et al.

(10) Patent No.: US 11,568,702 B2
(45) Date of Patent: Jan. 31, 2023

(54) VENDING MACHINE

(71) Applicant: PepsiCo, Inc., Purchase, NY (US)

(72) Inventors: Emad Jafa, Brewster, NY (US); Cheuk Chi Lau, White Plains, NY (US); Xuejun Li, White Plains, NY (US); Yong Serock, Newton, CT (US); Wai Ting Chan, Cambridge (GB); Samuel Luke Johnstone, Cambridge (GB); Martyn Thomas Mitchell, Royston (GB); Euan Morrison, Cambridge (GB); Erik David Williams, Cambridge (GB)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 16/130,717

(22) Filed: Sep. 13, 2018

(65) Prior Publication Data

US 2020/0090443 A1 Mar. 19, 2020

(51) Int. Cl.
*G07F 9/10* (2006.01)
*G07F 11/48* (2006.01)

(52) U.S. Cl.
CPC ..... *G07F 9/10* (2013.01); *G07F 11/48* (2013.01)

(58) Field of Classification Search
CPC ..... A61B 5/1117; A61B 5/00022; A61B 5/024; A61B 5/7264; A61B 2561/0219; G16H 40/67; G16H 40/63; G16H 20/13; G06N 20/00; G06F 15/76; G07F 11/60; G07F 9/10; G07F 11/48; B65G 1/137
USPC ..... 221/92; 700/237
See application file for complete search history.

(56) References Cited

U.S. PATENT DOCUMENTS 1,274,509 A * 8/1918 Burns ..... A47F 3/005 312/50
3,194,432 A * 7/1965 Breitenstein ..... G07F 11/58 221/129
3,251,505 A * 5/1966 Johnson ..... G07F 11/10 221/125

(Continued)

FOREIGN PATENT DOCUMENTS

CN 103310541 B 9/2013
CN 109785511 A * 5/2019 ..... G07F 11/16

(Continued)

OTHER PUBLICATIONS

International Search Report and Written Opinion issued in International Application No. PCT/US2019/048793, dated Nov. 4, 2019, 10 pages.

*Primary Examiner* — Rakesh Kumar
(74) *Attorney, Agent, or Firm* — Sterne, Kessler, Goldstein & Fox P.L.L.C.

(57) ABSTRACT

Vending machines for storing and dispensing products to consumers in a space-efficient manner. A vending machine may include a product compartment, a product storage system, a support structure, a dispensing port, and a product delivery system. The support structure may elevate the product compartment and form a void beneath the product compartment. Other structures may occupy the void beneath the product compartment, or humans may walk through the void beneath the product compartment. A product may be automatically moved from the product compartment to the dispensing port using the product delivery system.

12 Claims, 10 Drawing Sheets

(56) References Cited

U.S. PATENT DOCUMENTS

| | | | | | |
|---|---|---|---|---|---|
| 3,831,807 | A * | 8/1974 | Deaton | G07F 11/58 | 221/85 |
| 3,993,372 | A * | 11/1976 | Mihos | A47F 1/08 | 312/45 |
| 4,067,477 | A * | 1/1978 | Chalabian | G07F 11/045 | 221/241 |
| 4,119,192 | A * | 10/1978 | Hickman | G07F 5/06 | 194/235 |
| D279,908 | S * | 7/1985 | Wiese | D20/4 | |
| 4,583,658 | A | 4/1986 | Israel | | |
| 4,881,787 | A * | 11/1989 | King | A47F 1/08 | 312/297 |
| 6,513,667 | B2 | 2/2003 | Battaglia et al. | | |
| 6,682,289 | B1 * | 1/2004 | Credle, Jr. | G07F 11/163 | 221/95 |
| 2005/0284879 | A1 * | 12/2005 | Skavnak | G07F 11/16 | 221/192 |
| 2006/0004485 | A1 | 1/2006 | Thomas | | |
| 2007/0210100 | A1 * | 9/2007 | Skavnak | G07F 11/10 | 221/221 |
| 2010/0280655 | A1 | 11/2010 | Wilson et al. | | |
| 2011/0017761 | A1 | 1/2011 | Roncari et al. | | |
| 2020/0090443 | A1 * | 3/2020 | Jafa | G07F 11/48 | |

FOREIGN PATENT DOCUMENTS

| | | | | | |
|---|---|---|---|---|---|
| JP | 10340384 | A * | 12/1998 | G07F 11/60 | |
| JP | 2007257532 | A * | 10/2007 | G07F 11/00 | |
| JP | 2013191031 | A * | 9/2013 | G07F 11/32 | |
| WO | WO-2020145992 | A1 * | 7/2020 | G05B 15/02 | |

* cited by examiner

VENDING MACHINE

FIELD

The described embodiments generally relate to product dispensers, such as vending machines. In particular, embodiments relate to a vending machine having a vertically displaced product compartment.

BACKGROUND

Vending machines enable consumers to purchase a variety of products, such as foods, beverages, or other consumable goods on demand. As an alternative to some retail environments offering similar products for sale (such as, for example, convenience stores or kiosks), vending machines have a number of advantages. For example, some vending machines do not require the presence of an employee to complete a transaction, thereby lowering operating costs and making the machines an inexpensive means for selling goods to consumers. Further, some vending machines allow for quick and efficient transactions, enhancing a consumer's purchasing experience.

BRIEF SUMMARY OF THE INVENTION

Some embodiments of the present invention provide vending machines that can be used in areas with limited space or limited floor space, or in areas of convenience for consumers that are not traditionally occupied by vending machines. They allow a consumer to conveniently select, purchase, and receive a product from a dispensing port, while the products are stored in a compartment that is out of the way.

For example, embodiments include vending machines for storing and dispensing products, where the vending machine includes a U-shaped housing, a product compartment, and a dispensing port. The U-shaped housing includes a first support wall and a second support wall. The product compartment is elongated and displays a row of products to be vended. The product compartment extends horizontally between the first support wall and the second support wall. The product compartment includes a top surface and a bottom surface, and the space between the bottom surface and the support walls define a void below the product compartment. The dispensing port is coupled to the product compartment, and a user may access the dispensing port to receive a vended product.

Embodiments also include a product dispenser, where the product dispenser includes a support structure, a product compartment, and a dispensing port. The support structure extends vertically from a floor. The product compartment stores products to be vended and extends horizontally from the support structure. The product compartment includes a top surface and a bottom surface that define a height of the product compartment. The product compartment is vertically elevated and supported by the support structure such that there is a space between the floor and the bottom surface of the product compartment, and the height of the product compartment is less than the distance between the floor and the bottom surface of the product compartment. The dispensing port is coupled to the product compartment, and a user may access the dispensing port to receive a vended product.

Embodiments also include a vending machine for storing and dispensing products, where the vending machine includes a product compartment for storing products, a dispensing port, and a passage. The dispensing port is interconnected to but spatially separated from the product compartment. The passage has a first end and a second end. The first end of the passage is coupled to an opening in the product compartment, and the second end of the passage is coupled to an opening in the dispensing port. During a dispensing operation, a product in the product compartment is automatically moved from the product compartment, through the passage, and into the dispensing port. A user may access the dispensing port to receive a vended product.

BRIEF DESCRIPTION OF THE FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

DETAILED DESCRIPTION OF THE INVENTION

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The self-contained nature of some vending machines may allow for selective placement of the machines in locations that maximize consumer convenience. In fact, the profitability of some vending machines may be significantly correlated with the placement of the vending machine in, or in proximity to, locations of convenience for consumers, which may include areas of high consumer traffic. However, some vending machines may have designs and functionality that restrict the placement of the machine to locations with large amounts of available space and, in particular, large amounts of available floor space.

Some embodiments may provide flexibility in the placement of product dispensers, such as vending machines, by reducing the amount of floor space that must be dedicated solely to the machine. In this manner, some embodiments may provide a vending machine with a reduced vending footprint. Vending machines as described herein may include a product compartment for storing, displaying, and/or dispensing products (e.g. foods and/or beverages) that is interconnected to, but spatially separated from, a dispensing port whereby a consumer receives a vended product during a dispensing operation. This configuration may allow the dispensing port to be placed in a convenient location accessible by consumers, while the product compartment is spatially separated and out of the way.

Figure 3:
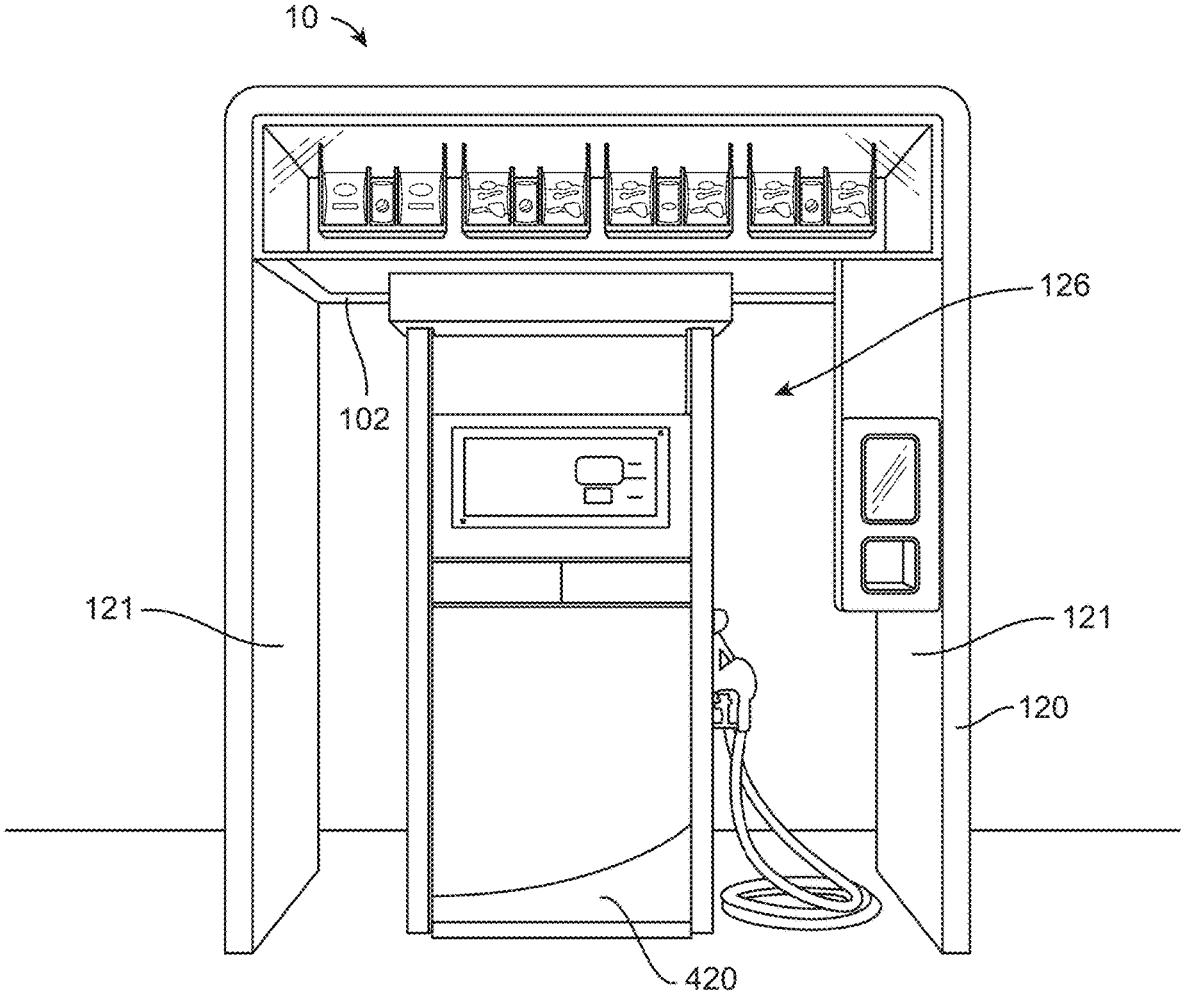
FIG. 3 is a front perspective view of the vending machine of FIG. 1 in an environment in which it may be used.

Vending machines as described herein may include a product compartment for storing and dispensing products, a support structure that supports the product compartment in an elevated position, an empty space beneath the product compartment such that, for example, other structures may occupy the space beneath the product compartment, and a dispensing port coupled to and disposed beneath the product compartment whereby a consumer receives a vended product during a dispensing operation. Vending machines according to some embodiments may be used, for example, in spaces that may not traditionally be occupied by vending machines, such as in proximity to gas station pumps (see, for example, FIG. 3).

Figure 4:
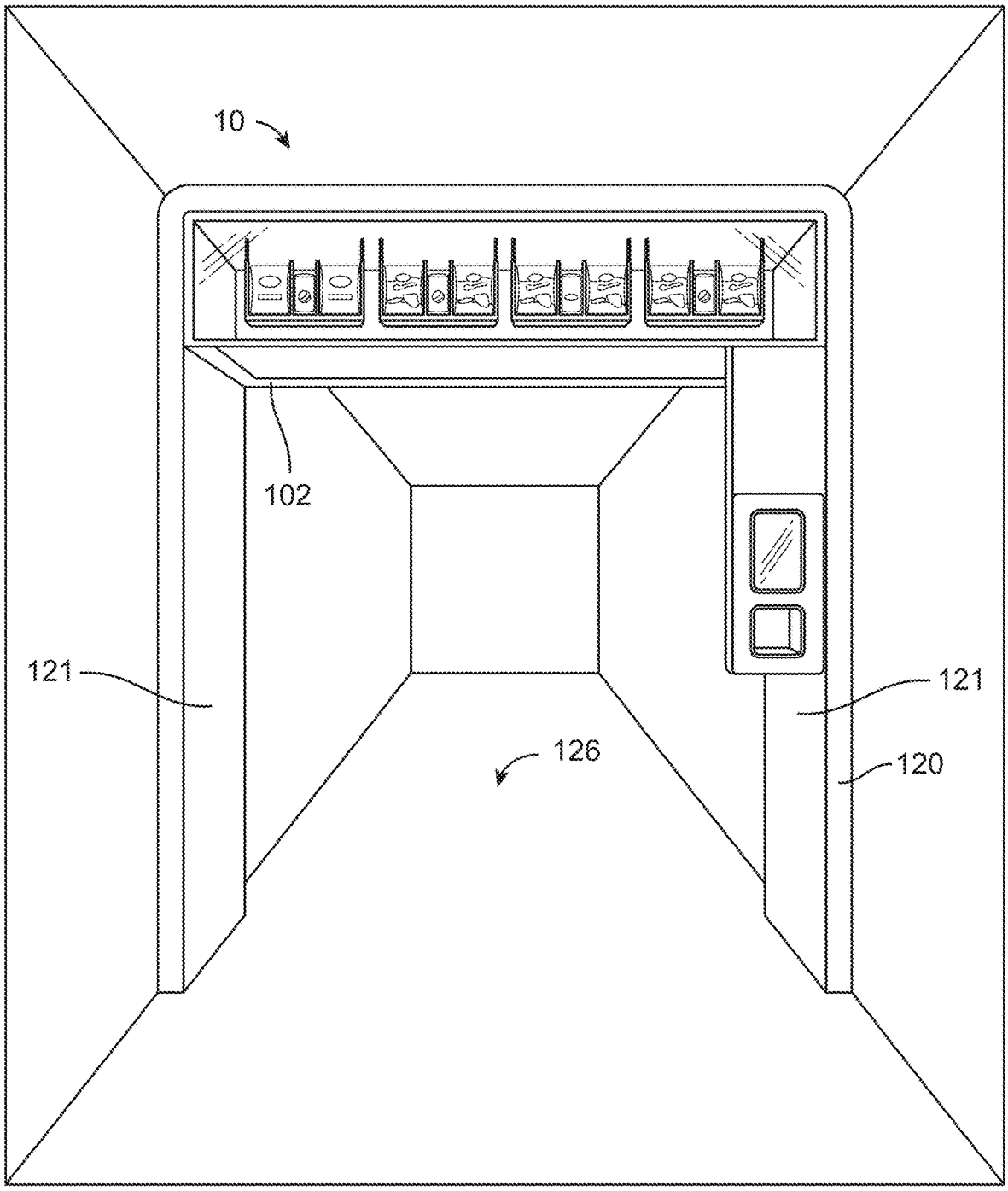
FIG. 4 is a front perspective view of the vending machine of FIG. 1 in an environment in which it may be used.

Vending machines as described herein may include a product compartment for storing and dispensing products, a support structure that supports the product compartment in an elevated position, an empty space beneath the product compartment of sufficient height and width such that a human may walk beneath the product compartment, and a dispensing port coupled to and disposed beneath the product compartment whereby a consumer receives a vended product during a dispensing operation. Vending machines according to some embodiments may be used, for example, in spaces that may not traditionally be occupied by vending machines, such as narrow hallways (see, for example, FIG. 4).

Vending machines as described herein may include a product compartment for storing and dispensing products (e.g. foods or beverages) that is disposed, for example, behind a wall, partially or fully in a wall, or at a remote location that is interconnected to but spatially separated from a dispensing port whereby a consumer receives a vended product during a dispensing operation.

Figure 1:
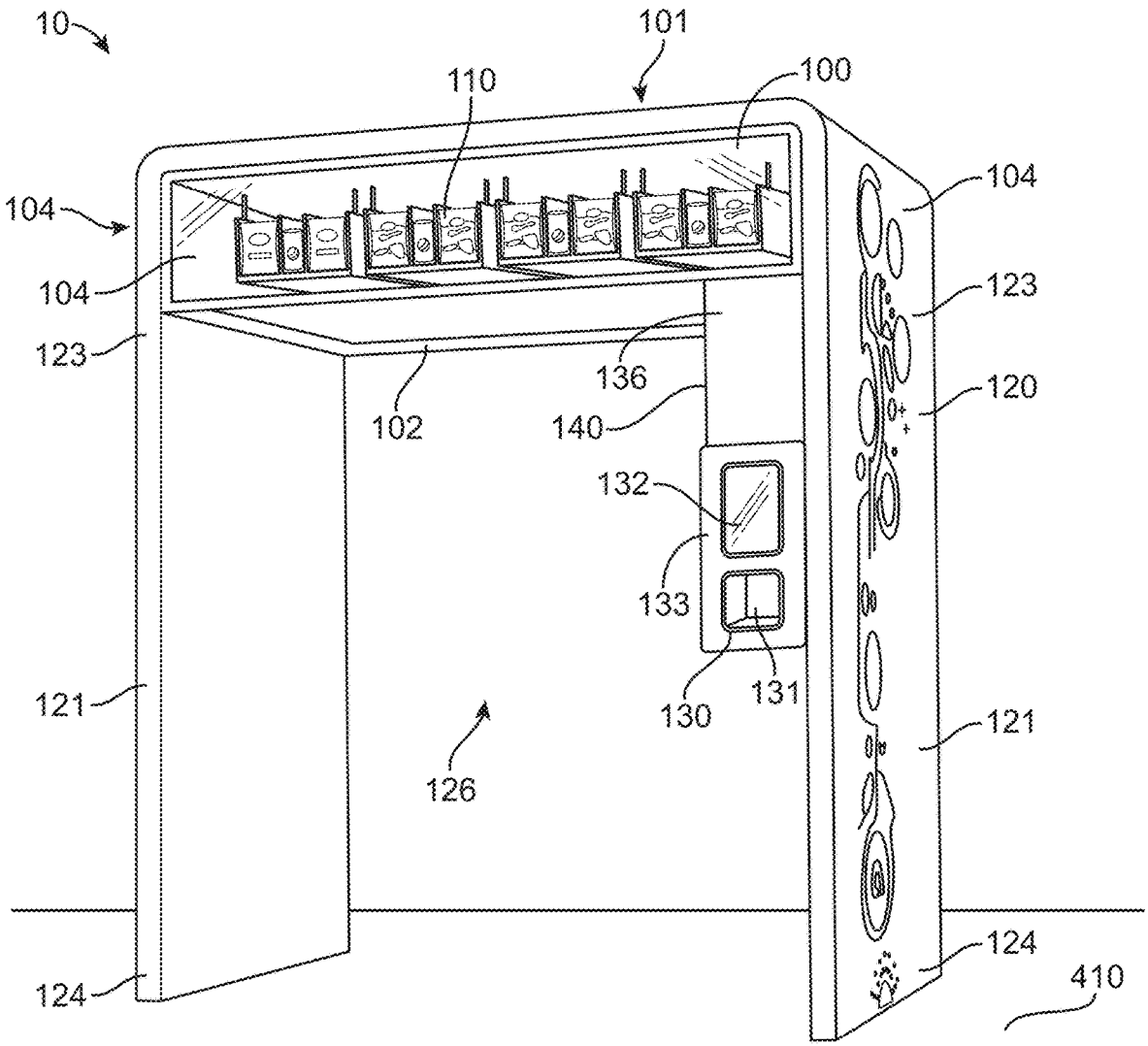
FIG. 1 is a perspective view of a vending machine according to some embodiments.
Figure 2:
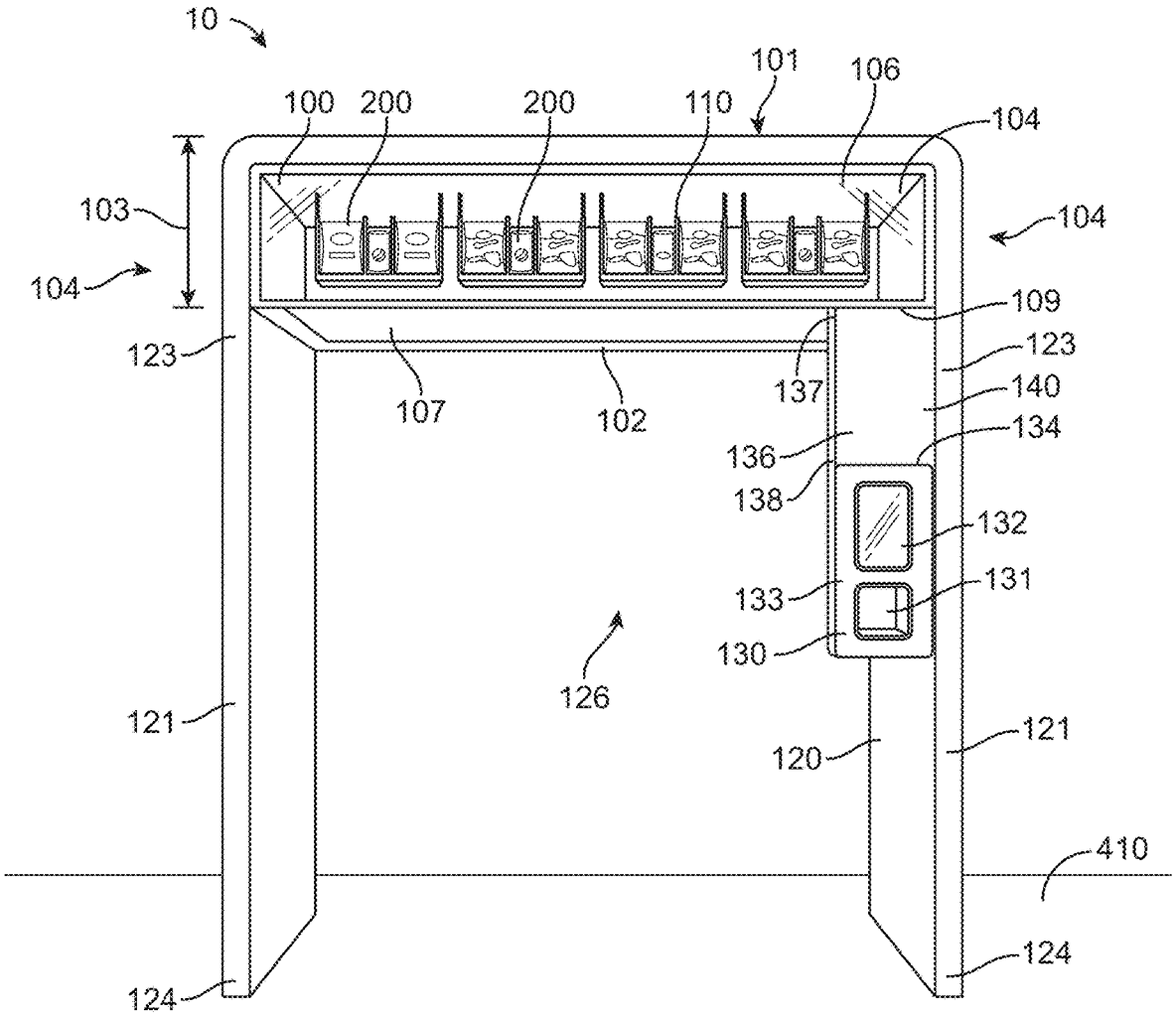
FIG. 2 is a front perspective view of the vending machine of FIG. 1.

Embodiments will now be described in more detail with reference to the figures. With reference to FIGS. 1-2, a vending machine 10 may include a product compartment 100, a product storage system 110, a support structure 120, a dispensing port 130, and a product delivery system 140.

Product compartment 100 is configured to store, display, and/or dispense one or more products 200 to be vended to a consumer. Products 200 are stored in product storage system 110 and may include perishable and non-perishable products. Products 200 may include, but are not limited to, chips, candy bars, soft drinks, water, carbonated water, juices, alcoholic beverages, sports drinks, or other pre-made packaged goods.

Product compartment 100 may include a top surface 101, a bottom surface 102, and sides 104. The distance between top surface 101 and bottom surface 102 may define a height 103 of product compartment 100.

In some embodiments, support structure 120 is configured to support product compartment 100 in an elevated position such that vending machine 10 may be conveniently located and may have a reduced footprint. As shown in FIGS. 1-2, support structure 120 may include one or more support walls 121, each of which may include a first end 123 and a second end 124. In some embodiments, support structure 120 may be generally U-shaped and may include two support walls 121 interconnected to product compartment 100. The support walls 121 may be substantially parallel to one another and first ends 123 of support walls 121 may be disposed on opposing sides 104 of product compartment 100. Support walls 121 may be substantially plumb relative to a floor 410, and second ends 124 of support walls 121 may be in communication with floor 410.

Support structure 120 may support product compartment 100 such that product compartment 100 is disposed vertically above floor 410 and a void 126 (e.g., an empty or unoccupied space) is disposed below the product compartment 100. The void 126 may be disposed in the area between one or more support walls 121 and beneath bottom surface 102 of product compartment 100. It will be appreciated that floor 410, for ease of description, is called a floor, however it may be another surface on which support structure 120 may be disposed such as, for example, the ground, a sidewalk, or a parking lot. In some embodiments, a height 103 of product compartment 100 may be less than the distance between floor 410 and bottom surface 102 of product compartment 100, which may define the height of void 126. In this manner, the ratio of the height 103 of product compartment 100 to the height of void 126 may be less than 1. In some embodiments, the ratio of the height 103 of product compartment 100 to the height of void 126 may be less than 0.5. In some embodiments, the ratio of the height 103 of product compartment 100 to the height of void 126 may be less than 0.2.

In some embodiments, void 126 may be sufficiently sized, and may have sufficient height, area, and/or volume, such that a structure 420 may be disposed within or partially within void 126. Structure 420 may be, for example, a fuel dispenser (e.g., a gas station gasoline pump), a shelf, a retail display, or a doorway. Structure 420 may also be, for example, an advertisement structure, an area for consumer engagement, a smaller vending machine, a drinking fountain, a soda fountain, or a bicycle rack. In some embodiments, void 126 may have dimensions such that a human may walk upright into or through void 126. In some embodiments, bottom surface 102 of product compartment 100 may be vertically displaced from floor 410 by at least 4 feet. In some embodiments, bottom surface 102 of product compartment 100 may be vertically displaced from floor 410 by greater than 6 feet. In some embodiments, bottom surface 102 of product compartment 100 may be vertically displaced from floor 410 by a distance between 6.5 feet and 8 feet, inclusive. In some embodiments, two substantially parallel support walls 121 may be laterally displaced by at least 2 feet.

In some embodiments, product compartment 100 comprises an elongated rectangular cuboid shape. In some embodiments, product compartment 100 may comprise other shapes, including, for example, cubical, tubular, cylindrical or frustoconical, and may or may not be symmetrical about any axis. Product compartment 100 may include a door 107 that is disposed on top surface 101, bottom surface 102, or a side 104 of product compartment 100. Door 107 may provide access to the interior 108 of product compartment 100, where products 200 are stored in product storage system 110.

Figure 5:
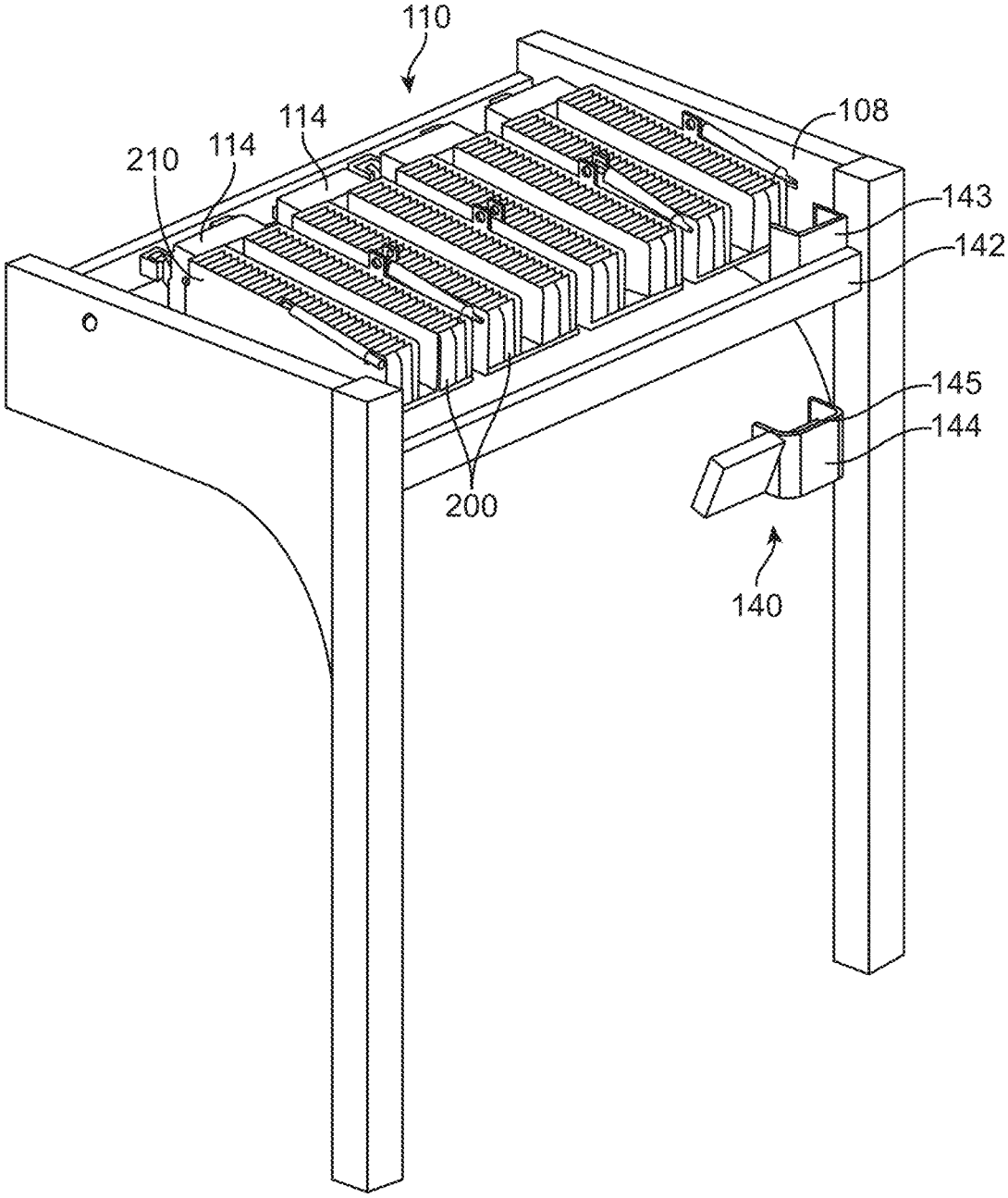
FIG. 5 is a partial perspective view of a vending machine according to some embodiments.
Figure 6:
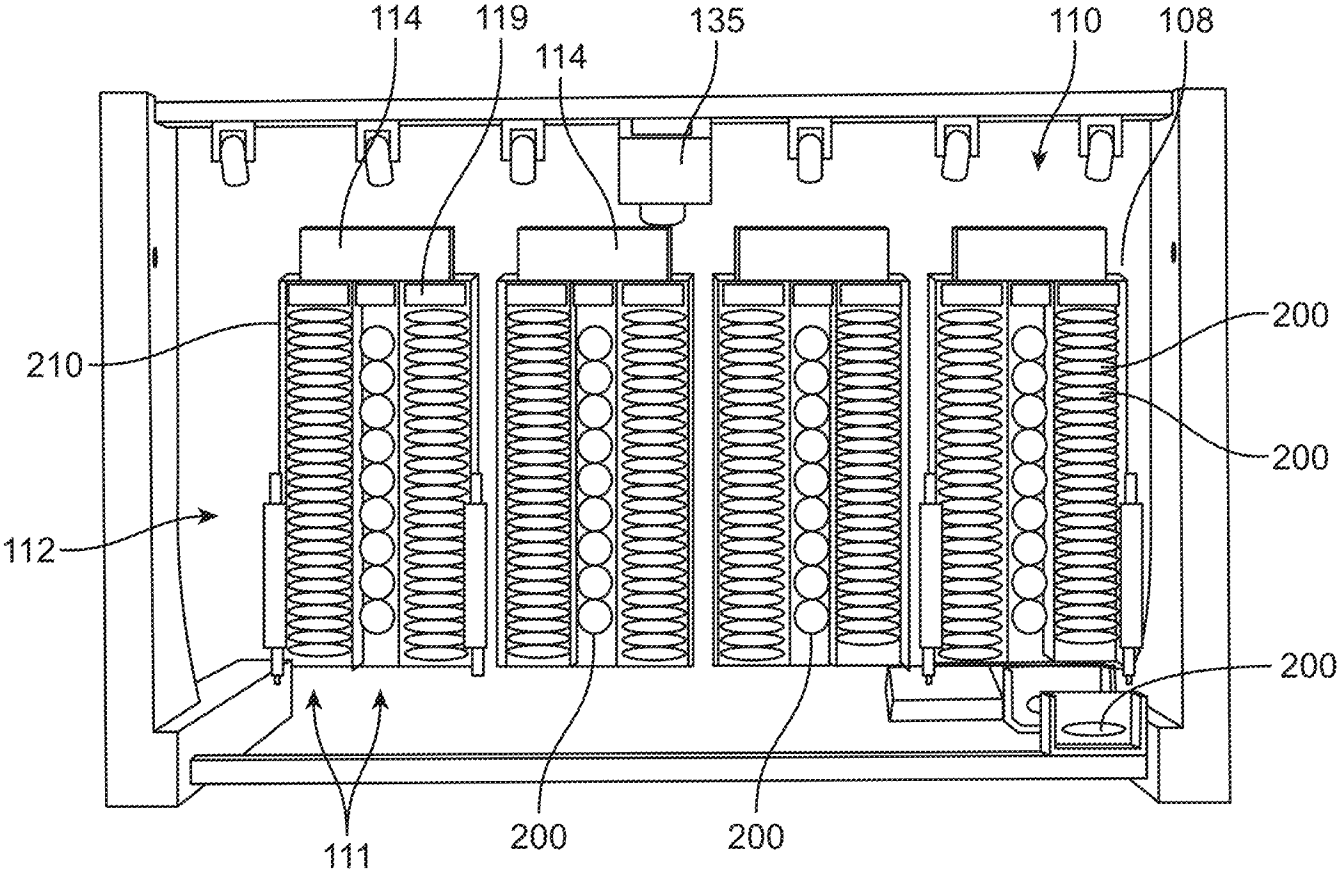
FIG. 6 is a top view of the vending machine of FIG. 5.

As shown in FIGS. 5-6, product storage system 110 may be used for storing and organizing products 200, and may include one or more product receptacles 114. In some embodiments, products 200 may be arranged into a column 111 within product receptacle 114. Multiple columns 111 of products 200 may be positioned adjacent to one another, forming a row 112 of products 200. As shown in FIG. 2, product compartment 100 may include a single horizontal row 112 formed by twelve columns 111 of products 200. However, product compartment 100 may include any number of rows 112 in any arrangement (e.g., horizontal, vertical, and/or diagonal) formed by any number of columns 111.

In some embodiments, product receptacle 114 may include one or more product actuators 119 in which, or on which, for example, products 200 are disposed. Product actuator 119 may be a mechanism for displacing products 200 during a dispensing operation. In one embodiment, product actuator 119 comprises a coil that linearly displaces products 200 when rotated. In other embodiments, product actuator 119 may comprise a conveyer system that linearly displaces products 200, or a hydraulic, pneumatic, or electrical actuator that pushes or pulls products 200.

Figure 9B:
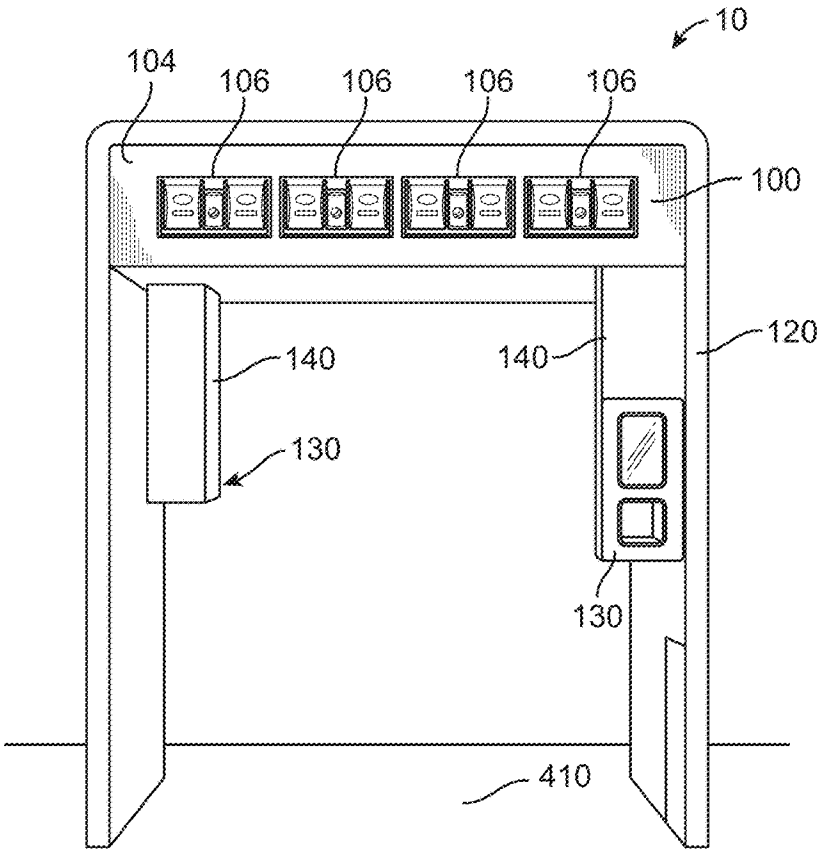
FIG. 9B is a rear perspective view of the vending machine of FIG. 9A.
Figure 9A:
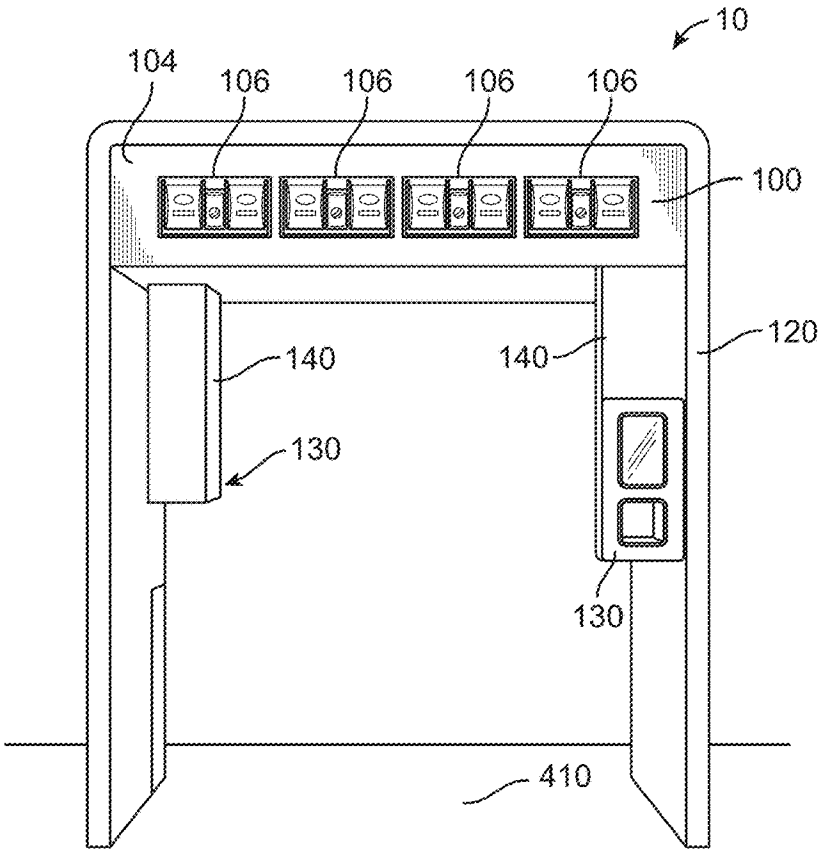
FIG. 9A is a front perspective view of a vending machine according to some embodiments.

As shown, for example, in FIGS. 9A and 9B, one or more sides 104 of product compartment 100 may include one or more display windows 106, thereby allowing a consumer to see into product compartment 100. The number and/or position of display windows 106 may or may not correspond to the number and/or position of rows 112 of products 200. In some embodiments, one of more sides 104 of product compartment 100 may be made of a transparent material (e.g., glass or plastic), thereby allowing a consumer to see into the product compartment 100. In some embodiments, the display window 106 may include a lens or other component to magnify the size of the product 200 displayed within the window. Because the product compartment 200 may be elevated at a vertical height away from the user, magnifying the product 200 may facilitate the consumer viewing the product selections from a greater distance.

In some embodiments, the position of product storage system 110 may be rigidly interconnected to product compartment 100. In other embodiments, however, the position of product storage system 110 may be adjustable (or product storage system 110 may be removable from product compartment 100) to facilitate the addition of products 200 to product storage system 110, as shown, for example, in FIG. 7. Similarly, each of product receptacles 114 of product storage system 110 may be individually adjustable or removable from product compartment 100. For example, in one embodiment, a product receptacle 114 may be tilted or lowered to facilitate loading. Door 107 may be opened to allow for the adjustment or removal of product receptacle 114.

Figure 7:
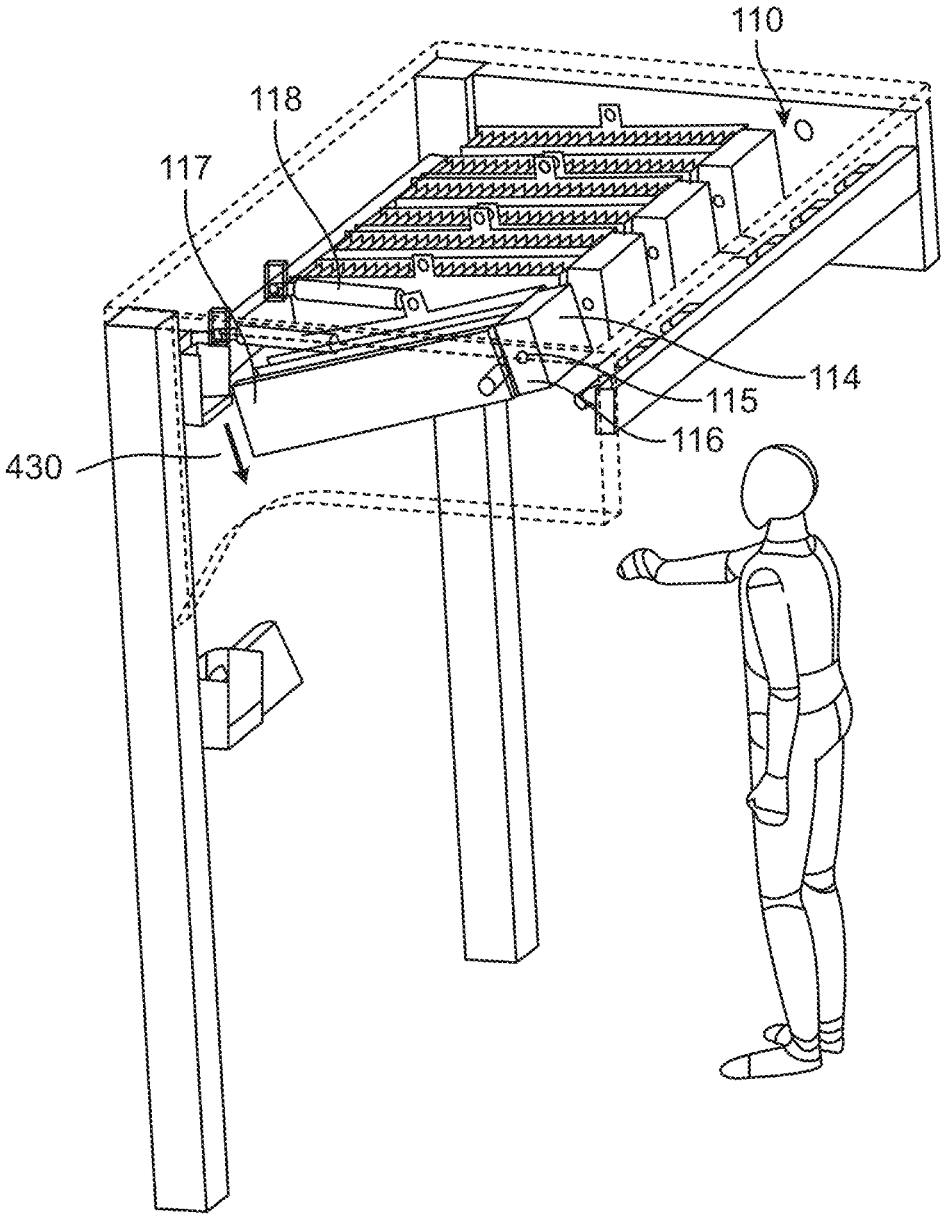
FIG. 7 is a partial perspective view of a vending machine according to some embodiments.

As shown in FIG. 7, in some embodiments, a first end 116 of product receptacle 114 may be rotatably interconnected though a hinge 115 to product compartment 100, and a second end 117 of product receptacle 114 (or a point along the length of product receptacle 114) may be interconnected through a biasing member 118 to product compartment 100 such that product receptacle 114 is supported in a substantially horizontal position within product compartment 100. A tangential force 430 may then be applied at second end 117 of product receptacle 114, thereby causing product receptacle 114 to rotate about hinge 115. Biasing member 118 may be, for example, a gas strut, gas spring, coil spring, or other linear or non-linear biasing mechanism. Biasing member 118 may also be located at first end 116, and may be, for example, a torsional spring.

In some embodiments, hinge 115 and biasing member 118 may be interchanged with another means for operably raising or lowering one or both ends 116, 117 of product receptacle 114. For example, one or more hydraulic, pneumatic, or electrical actuators may be used to raise or lower one of first or second ends 116, 117 of product receptacle 114, or to raise or lower both first and second ends 116, 117 of product receptacle 114 simultaneously. In some embodiments, product receptacle 114 may be raised or lowered manually, and secured in place in a variety of ways, such as, for example, with a pin or other locking mechanism.

Product receptacle 114 may also be configured to receive a product cartridge 210, which may be filled with products 200 (e.g., a column 111 of products 200) prior to its placement in product receptacle 114.

Product compartment 100 may include a cooling system for cooling products 200 or maintaining products 200 at a consistent temperature. Cooling system may be, for example, an air conditioning system, a heat pump, a refrigeration or freezer system, an evaporative cooler, or other temperature reduction system.

In some embodiments, product compartment 100 may include an inventory tracking system for monitoring the quantity and types of products 200 disposed in product storage system 110. The inventory tracking system may communicate (e.g., wirelessly) information about the quantity and types of products 200 in product storage system 110 to a remote location.

Figure 8:
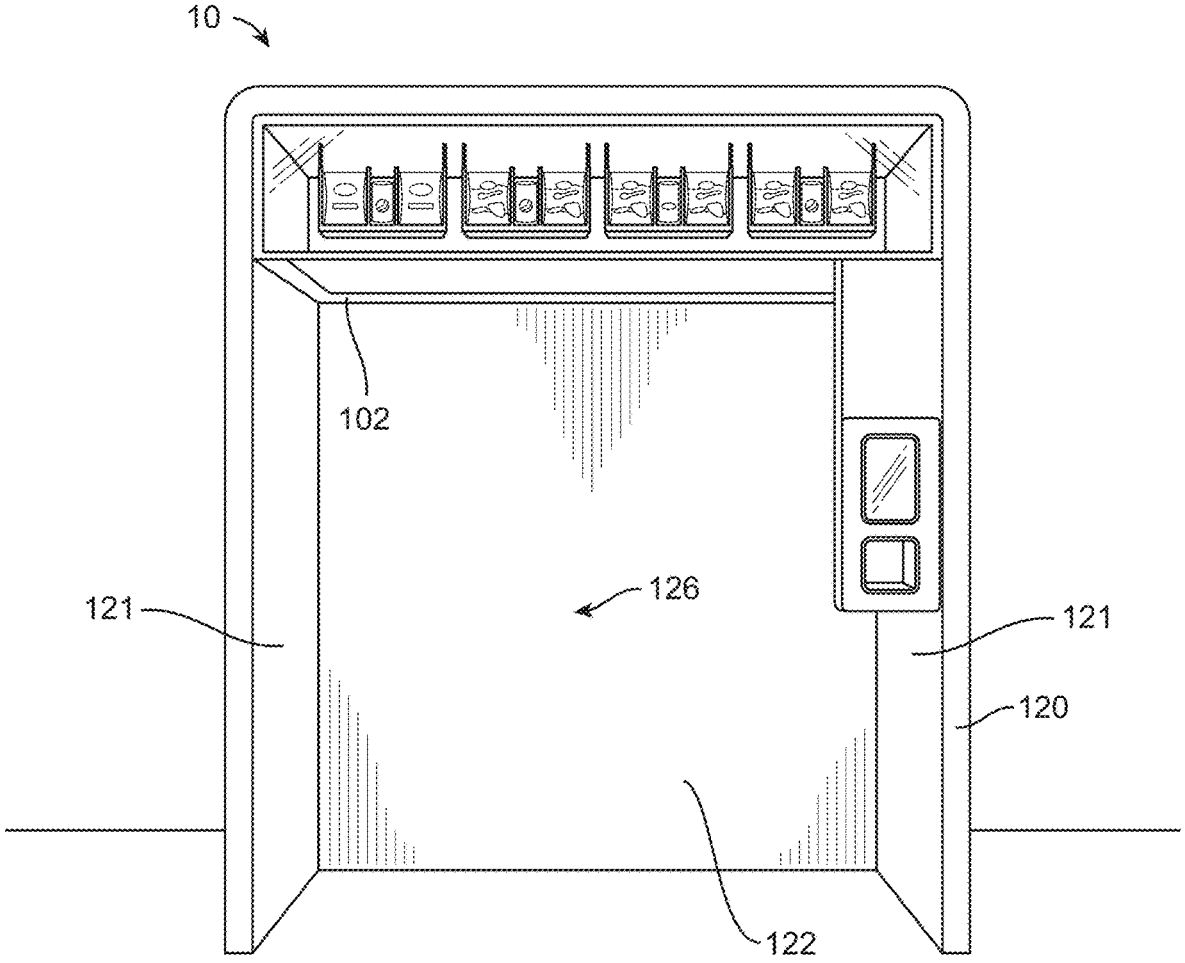
FIG. 8 is a front perspective view of a vending machine according to some embodiments.

Although shown in FIGS. 1-2 as having two substantially parallel support walls 121, support structure 120 may include more than or fewer than two support walls 121. In some embodiments support structure 120 may include two substantially parallel support walls 121 and a back support wall 122 disposed on three adjacent sides 104 of product compartment 100. Void 126 may be formed in the area between walls 121, 122 and beneath bottom surface 102 of product compartment 100 (see, for example, FIG. 8). Similarly, support structure 120 may include two support walls 121 disposed on adjacent sides 104 of product compartment 100, or may include only one support wall 121. Support walls 121 may also be replaced with another means for supporting product compartment 100 such as, for example, a frame, a mount, or one or more legs, columns, arches, or beams.

Figure 10:
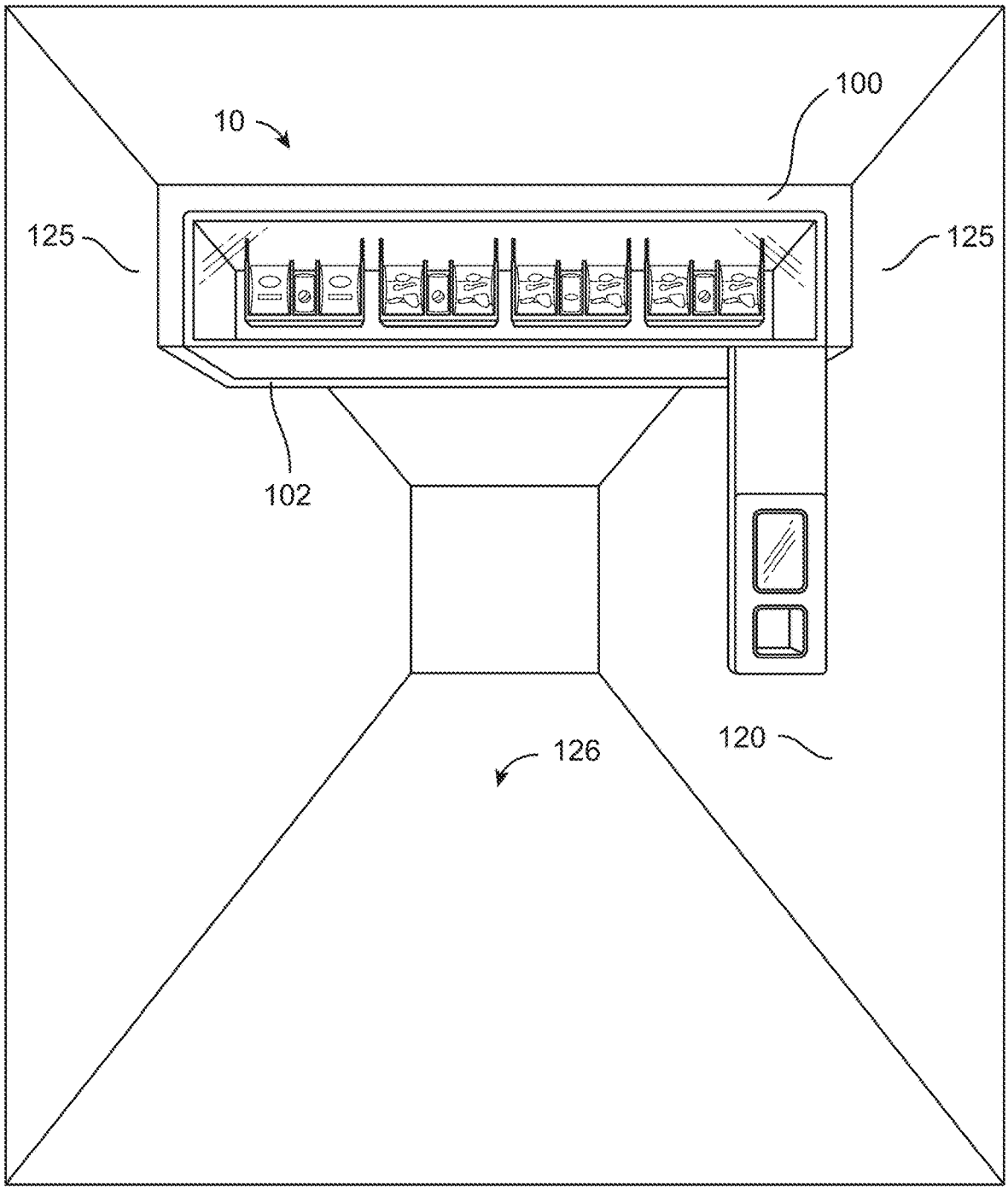
FIG. 10 is a front perspective view of a vending machine according to some embodiments.

As shown in FIG. 10, in some embodiments, support structure 120 may include building walls 125 configured to support product compartment 100 in an elevated position, where product compartment 100 extends between building walls 125. One or more sides 104 with one or more display windows 106 may be substantially perpendicular to the building walls 125. Void 126 may be formed in the area between building walls 125 and beneath bottom surface 102 of product compartment 100.

In some embodiments, a single building wall 125 may support product compartment 100 in an elevated position, and a side 104 with one or more display windows 106 may be substantially parallel to the building wall 125. In some embodiments, a single building wall 125 may support product compartment 100 in an elevated position, and one or more sides 104 with one or more display windows 106 may be substantially perpendicular to the building wall 125. In some embodiments, product compartment 100 may be partially disposed within and supported by a building wall 125, and a side 104 with one or more display windows 106 may be substantially parallel to the building wall 125.

In some embodiments, support structure 120 may be removably coupled to product compartment 100, for example, with bolts. In some embodiments, support structure 120 may be permanently affixed to product compartment 100, for example, with welds or an adhesive. In some embodiments, support structure 120 and product compartment 100 may form an integral housing.

In some embodiments, dispensing port 130 may include a dispensing opening 131 and a user interface 132. Dispensing opening 131 may be an aperture whereby a consumer receives a vended product. As shown, for example, in FIGS. 1-2, dispensing opening 131 may comprise a generally square shape, however it may take other shapes, including, for example, circular or rectangular. User interface 132 may include a means for receiving consumer input (e.g., electromechanical buttons), a means for communicating with a consumer (e.g., a visual display), and/or a combined means for receiving input and communicating with a consumer (e.g., a touch screen display). User interface 132 may include a combination of buttons, visual displays, and/or touch screens. User interface 132 may display information about products 200 in product compartment 100. User interface 132 may include one or more means for accepting payment from a consumer (e.g., a bill validator, coin slot, or credit card reader). In some embodiments, a consumer may use an application on a mobile communications device (e.g., a smartphone) to select and purchase product 200 to be vended.

In some embodiments, dispensing port 130 may be disposed within void 126. In some embodiments, dispensing port 130 may be disposed outside of void 126. In some embodiments, dispensing port 130 may be coupled to a support wall 121. In some embodiments, dispensing port 130 may be disposed above, below, or at a side of product compartment 100. In some embodiments, dispensing port 130 may be disposed in a different room than product compartment 100.

In some embodiments, dispensing opening 131 and user interface 132 may be disposed within a housing 133. Housing 133 may be fully or partially hollow. The position of housing 133 may be fixed relative to product compartment 100 or may be manually or automatically adjustable as described further below.

Dispensing port 130 may be interconnected to product compartment 100 by way of a passage 136. A first end 137 of passage 136 may be disposed at a compartment opening 109 in product compartment 100, and a second end 138 of passage 136 may be disposed at a housing opening 134 in housing 133, such that a product 200 may be moved from product compartment 100, though passage 136, and into housing 133 where a consumer may receive the product 200 from dispensing port 130. Although shown in FIGS. 1-2 as being substantially straight, passage 136 may take many forms and may include one or more bends, curves, and/or transitions, and may pass through other structures, for example, a wall.

In some embodiments, passage 136 may be telescoping such that the distance between first and second ends 137, 138 of passage 136 is adjustable, and, therefore, the position of dispensing port 130 is variable relative to product compartment 100. Similarly, in some embodiments, passage 136 may be flexible or collapsible such that the distance between first and second ends 137, 138 of passage 136 is adjustable, and, therefore, the position of dispensing port 130 is variable relative to product compartment 100. In some embodiments, dispensing port 130 may be spatially separated from product compartment 100 by at least 1 foot (e.g., between 2 and 10 feet). In some embodiments, vending machine 10 may include one or more sensors 135 (see, for example, FIG. 6) that measure the height of an approaching consumer and adjust the position of housing 133 (using, for example, an actuator) such that dispensing opening 131 and user interface 132 are at a comfortable and convenient height for the consumer.

In some embodiments, vending machine 10 may include more than one dispensing ports 130 disposed on various sides 104 of product compartment 100 such that vending machine 10 may dispense products 200 to consumers at several locations (see, for example, FIGS. 9A-9B).

As shown in FIG. 5, product delivery system 140 may include a first robotic implement 142 and a second robotic implement 144. In some embodiments, first robotic implement 142 and/or second robotic implement 144 may include a robotic arm configured to automatically lift, hold, and/or transport a product 200. In some embodiments, first robotic implement 142 and/or second robotic implement 144 may include a cup, container, clamp, suction system, or claw configured to hold a product 200. In some embodiments, first robotic implement 142 and/or second robotic implement 144 may include a robotic track system, a linear actuator, a conveyer, and/or another component configured to automatically receive and transport a product 200. In some embodiments, first robotic implement 142 may be disposed within product compartment 100 and may move transversely along a horizontal axis (e.g., an x-axis direction) of product compartment 100. In some embodiments, second robotic implement 144 may be disposed within passage 136 and may move longitudinally along a vertical axis (e.g., a y-axis direction) within passage 136. Although shown in FIG. 5 as having two robotic implements 142, 144, product delivery system 140 may take other forms, and may include more than, or fewer than two robotic implements. In some embodiments, product delivery system 140 may include one or more shoots, slides, or passageways to move product 200 from product compartment 100 to dispensing port 130 using the force of gravity.

During a dispensing operation according to some embodiments, a consumer may approach dispensing port 130, which may automatically adjust to the consumer's height. Then, the consumer may select and provide payment for a product 200 to be vended using, for example, user interface 132 or an application on a mobile communications device. Next, first robotic implement 142 may move such that first product holder 143 is positioned to receive the selected product 200 from product receptacle 114. Product actuator 119 may then move product 200 into first product holder 143 or, alternatively, first product holder 143 may take product 200 from product receptacle 114. Then, first robotic implement 142 may move horizontally through product compartment 100 toward second robotic implement 144, where second product holder 145 may receive product 200 from first product holder 143. Then, second robotic implement 144 may move vertically though passage 136 toward dispensing port 130. Finally, second product holder 145 may release product 200 into dispensing port 130, where the consumer may receive product 200 from dispensing opening 131.

During a dispensing operation according to some embodiments of the invention, a consumer may select and provide payment for a product 200 to be vended using, for example, user interface 132 or an application on a mobile communications device. Next, first robotic implement 142 may move such that first product holder 143 is positioned to receive the selected product 200 from product receptacle 114. Product actuator 119 may then move product 200 into first product holder 143 or, alternatively, first product holder 143 may take product 200 from product receptacle 114. Then, first robotic implement 142 may move through product compartment 100 toward second robotic implement 144, where second product holder 145 may receive product 200 from first product holder 143. Then, second robotic implement 144 may move though passage 136 toward dispensing port 130. Finally, second product holder 145 may release product 200 into dispensing port 130, where the consumer may receive product 200 from dispensing opening 131.

During a dispensing operation according to some embodiments of the invention, a consumer may select and provide payment for a product 200 to be vended using, for example, user interface 132 or an application on a mobile communications device. Next, first robotic implement 142 may move such that first product holder 143 is positioned to receive the selected product 200 from product receptacle 114. Product actuator 119 may then move product 200 into first product holder 143 or, alternatively, first product holder 143 may take product 200 from product receptacle 114. Then, first robotic implement 142 may move through product compartment 100 toward passage 136. Then, first product holder 143 may release product 200 into passage 136, where the force of gravity moves product 200 though passage 136 and into dispensing port 130, where the consumer may receive product 200 from dispensing opening 131.

During a dispensing operation according to some embodiments of the invention, a consumer may select and provide payment for a product 200 to be vended using, for example, user interface 132 or an application on a mobile communications device. Next product actuator 119 may move product 200 from product receptacle 114, where the force of gravity moves product 200 though passage 136 and into dispensing port 130, where the consumer may receive product 200 from dispensing opening 131.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A product dispenser, comprising:

a support structure extending vertically from a floor, wherein the support structure comprises a first wall and a second wall;

a product compartment configured to store products to be vended extending horizontally from the support structure, wherein the product compartment comprises a top surface and a bottom surface defining a height of the product compartment;

a dispensing port coupled to the product compartment and accessible by a user to receive a vended product;

a sensor configured to measure a height of an approaching consumer; and an actuator configured to adjust the height of the dispensing port, wherein the height of the dispensing port is automatically adjusted by the actuator based on the measured height of the approaching consumer, wherein the product compartment is vertically elevated and supported by the support structure such that a space is disposed directly below the bottom surface of the product compartment, between the floor and the bottom surface of the product compartment, and between the first wall and the second wall, wherein the dispensing port is disposed inside the space, and wherein the height of the product compartment is less than the distance between the floor and the bottom surface of the product compartment.

2. The product dispenser of claim 1, further comprising a robotic implement disposed in the product compartment.

3. The product dispenser of claim 2, wherein the robotic implement is configured to move transversely along an x-axis direction of the product compartment.

4. The product dispenser of claim 3, wherein the robotic implement only moves in the x-axis direction.

5. The product dispenser of claim 2, further comprising a plurality of product cartridges configured to hold one or more products to be vended.

6. The product dispenser of claim 1, further comprising:

a robotic implement;

a product cartridge configured to hold one or more products to be vended; and a dispensing opening, wherein the robotic implement is configured to move a product from the product cartridge to the dispensing opening.

7. The product dispenser of claim 1, wherein the support structure and the product compartment form a vending machine housing.

8. The product dispenser of claim 1, further comprising a back wall disposed behind the space.

9. A vending machine for storing and dispensing products, the vending machine comprising:

a support structure comprising a first wall and a second wall, wherein the first wall and the second wall are vertically oriented;

a product compartment for storing products disposed between the first wall and the second wall;

a first dispensing port interconnected to but spatially separated from the product compartment, wherein the first dispensing port is disposed between the first wall and the second wall;

a first passage having a first end and a second end, wherein the first end is coupled to an opening in the product compartment and the second end is coupled to an opening in the first dispensing port;

a second dispensing port interconnected to but spatially separated from the product compartment, wherein the second dispensing port is disposed between the first wall and the second wall; and a second passage having a first end and a second end, wherein the first end is coupled to a second opening in the product compartment and the second end is coupled to an opening in the second dispensing port.

10. The product dispenser of claim 9, wherein the first dispensing port and product compartment are spatially separated by at least 2 feet.

11. The product dispenser of claim 9, further comprising a first robotic implement disposed in the product compartment.

12. The product dispenser of claim 11, further comprising a second robotic implement disposed in the first passage.

* * * * *